US007749140B1

(12) United States Patent
Lindemeier et al.

(10) Patent No.: US 7,749,140 B1
(45) Date of Patent: Jul. 6, 2010

(54) EXERCISE APPARATUS WITH CONNECTION ASSEMBLY

(75) Inventors: John R. Lindemeier, Sherburne, MN (US); John M. Cassidy, Wright, MN (US); Thomas M. Kilgriff, Anoka, MN (US)

(73) Assignee: Brunswick Corporation, Lake Forest, IL (US)

( * ) Notice: Subject to any disclaimer, the term of this patent is extended or adjusted under 35 U.S.C. 154(b) by 1384 days.

(21) Appl. No.: 11/186,465

(22) Filed: Jul. 21, 2005

(51) Int. Cl.
*A63B 21/02* (2006.01)

(52) U.S. Cl. ..... 482/82; 482/126; 482/49; 482/139

(58) Field of Classification Search ..... 482/139, 482/121, 122, 126, 148, 96–104, 91, 81, 482/82, 124
See application file for complete search history.

(56) References Cited

U.S. PATENT DOCUMENTS

| | | | | |
|---|---|---|---|---|
| 1,538,844 | A * | 5/1925 | Titus | 482/139 |
| 4,489,934 | A * | 12/1984 | Miller | 482/82 |
| 4,809,972 | A | 3/1989 | Rasmussen et al. | |
| 4,900,018 | A | 2/1990 | Ish, III et al. | |
| 6,113,520 | A * | 9/2000 | Greiner | 482/82 |
| 7,326,157 | B2 * | 2/2008 | Wu | 482/126 |
| 2005/0137066 | A1 * | 6/2005 | Wu | 482/126 |

* cited by examiner

*Primary Examiner*—Jerome Donnelly
(74) *Attorney, Agent, or Firm*—Andrus, Sceales, Starke & Sawall, LLP

(57) ABSTRACT

A quick disconnect and re-connect system is provided for exercise apparatus having a connection assembly for connecting a user-gripped handle to a resistance-bearing cable.

17 Claims, 5 Drawing Sheets

EXERCISE APPARATUS WITH CONNECTION ASSEMBLY

BACKGROUND AND SUMMARY

The invention relates to exercise apparatus, and more particularly exercise apparatus having a connection assembly for connecting a user-gripped handle to a resistance-bearing cable.

Exercise apparatus are known with various connection assemblies for connecting a user-gripped handle to a resistance-bearing cable. The present invention provides a simple, effective, quick connect assembly for accomplishing the noted connection.

DETAILED DESCRIPTION

Figure 1:
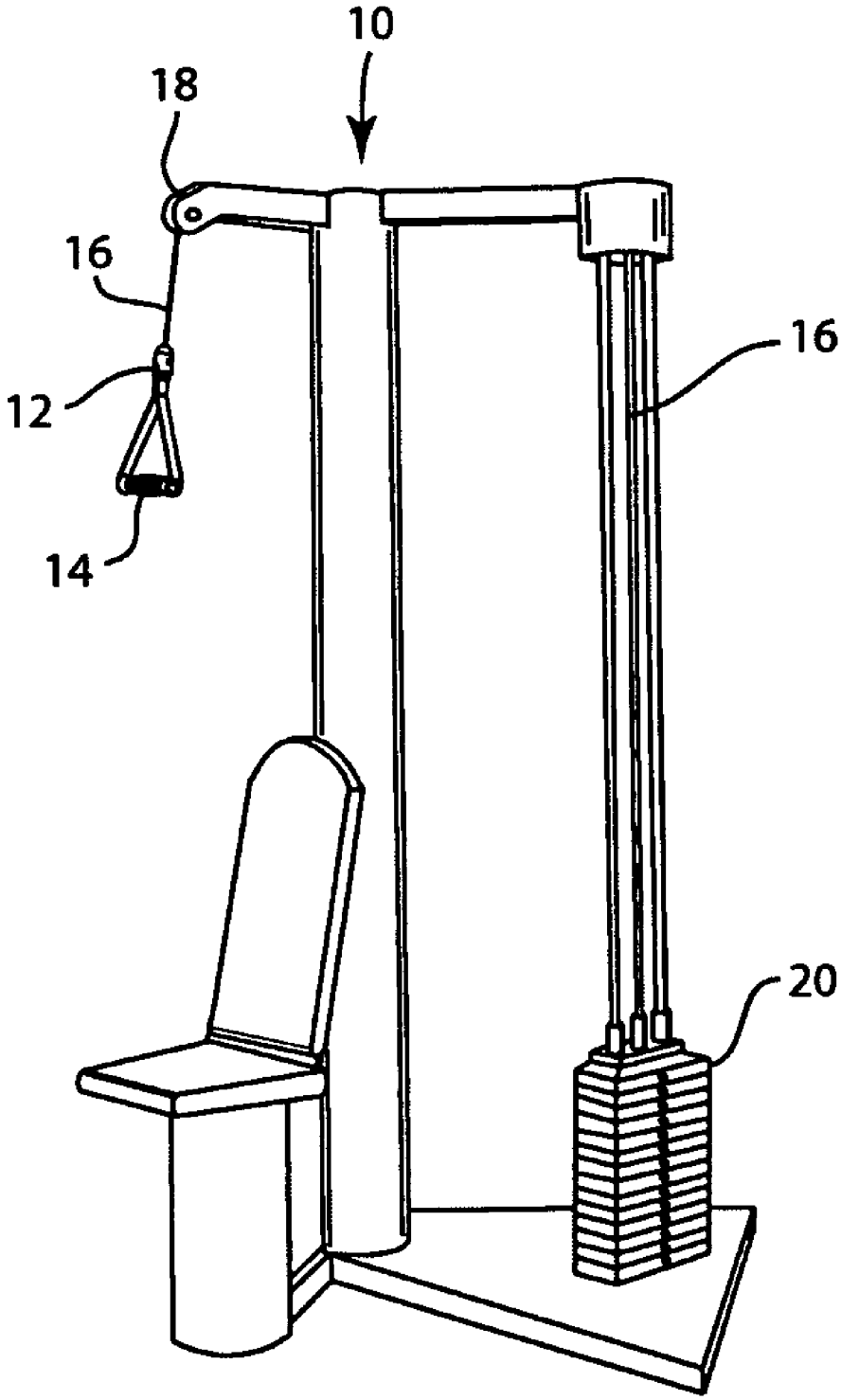
FIG. 1 is an isometric view of exercise apparatus having a connection assembly for connecting a user-gripped handle to a resistance-bearing cable.
Figure 2:
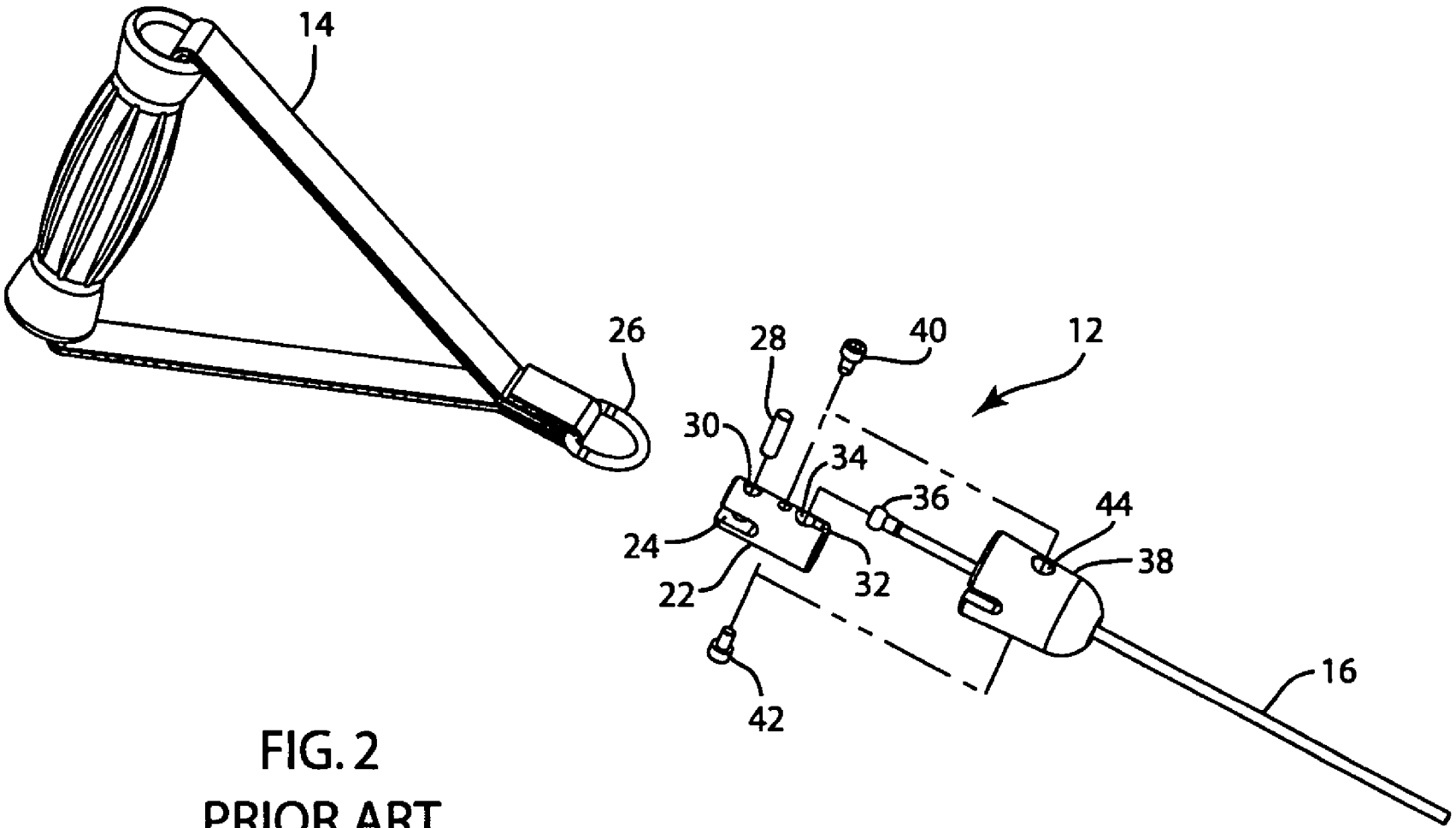
FIG. 2 PRIOR ART
FIG. 2 is an exploded isometric view of a connection assembly known in the prior art.

FIG. 1 shows exercise apparatus 10 including a connection assembly 12 for connecting a user-gripped handle 14 to a resistance-bearing cable 16 which may for example be trained around a pulley system 18 and connected at its other end to a weight stack 20, as is known. The user-gripped handle 14 may take various forms, including a single hand grip, a dual hand grip such as a cross bar, a pull rope, and so on, as is known. Connection assembly 12 includes a barrel 22, FIG. 2, having a slot 24 at one end receiving a ring or yoke 26 of the handle and retaining same by a transverse cross pin 28 inserted through holes 30 after insertion of ring 26 into slot 24. The other end of the barrel has a slot 32 with an enlarged ball socket 34 at the inner end thereof receiving enlarged ball end 36 of cable 16 and retained therein by a collar 38 mounted to barrel 22 by one or more set screws, for example allen hex head screws 40, 42 extending through respective holes such as 44 in collar 38. Collar 38 traps enlarged ball end 36 in ball socket 34 to prevent radial outward movement thereof, and the narrower throat section 32 of the slot prevents axial movement of ball end 36, all as is known. Collar 38 also covers transverse cross pin 28 to prevent removal thereof, and thus also retain trapped engagement of handle 14 to barrel 22. To disconnect the handle, for repair or to change to a different handle, set screws 40, 42 are unscrewed and removed, followed by axial sliding of collar 38 away from handle 14, followed by removal of pin 28 radially out of aperture 30, followed by axial sliding of handle 14 at ring 26 out of slot 24.

FIGS. 3-6 show the present invention and use like reference numerals from above where appropriate to facilitate understanding. The exercise apparatus includes a connection assembly 50 for connecting user-gripped handle 14 to resistance-bearing cable 16. The connection assembly includes a barrel 52, FIGS. 3, 4, extending axially along an axis 54 and having first and second distally opposite axial ends 56 and 58. Axial end 56 has a hook portion 60 engaging handle 14 at ring or yoke 62 in hooked relation. Second axial end 58 has a trap portion 64 engaging cable 16 in trapped relation, for example trap portion 64 may have an entrance throat such as 32, FIG. 2, and an enlarged ball socket 34 engaging cable 16 at enlarged ball end 36 in trapped relation, as in FIG. 2. A first collar 66 is provided around barrel 52 at axial end 58 and is attached to the barrel, for example by one or more alien head set screws 68, 70 extending through respective apertures such as 72 in collar 66 and threaded into respective holes such as 74 in barrel 52, to retain cable 16 in trapped relation engaging barrel 52, for example trapped engagement of enlarged ball end 36 in ball socket 34, with collar 66 preventing radial movement of ball end 36 out of socket 34, as above in FIG. 2.

Figure 3:
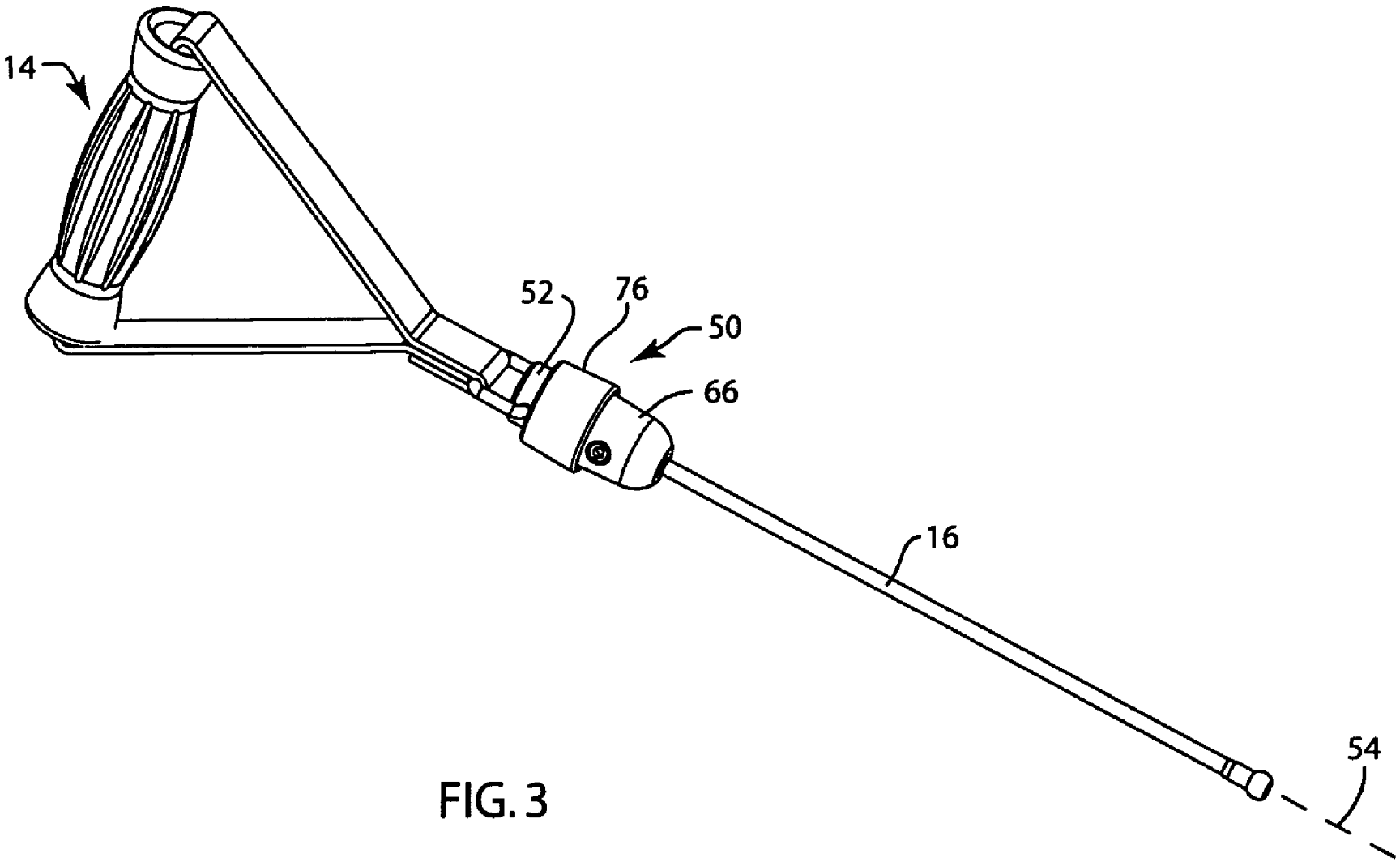
FIG. 3 is an isometric view of a connection assembly in accordance with the present invention.
Figure 4:
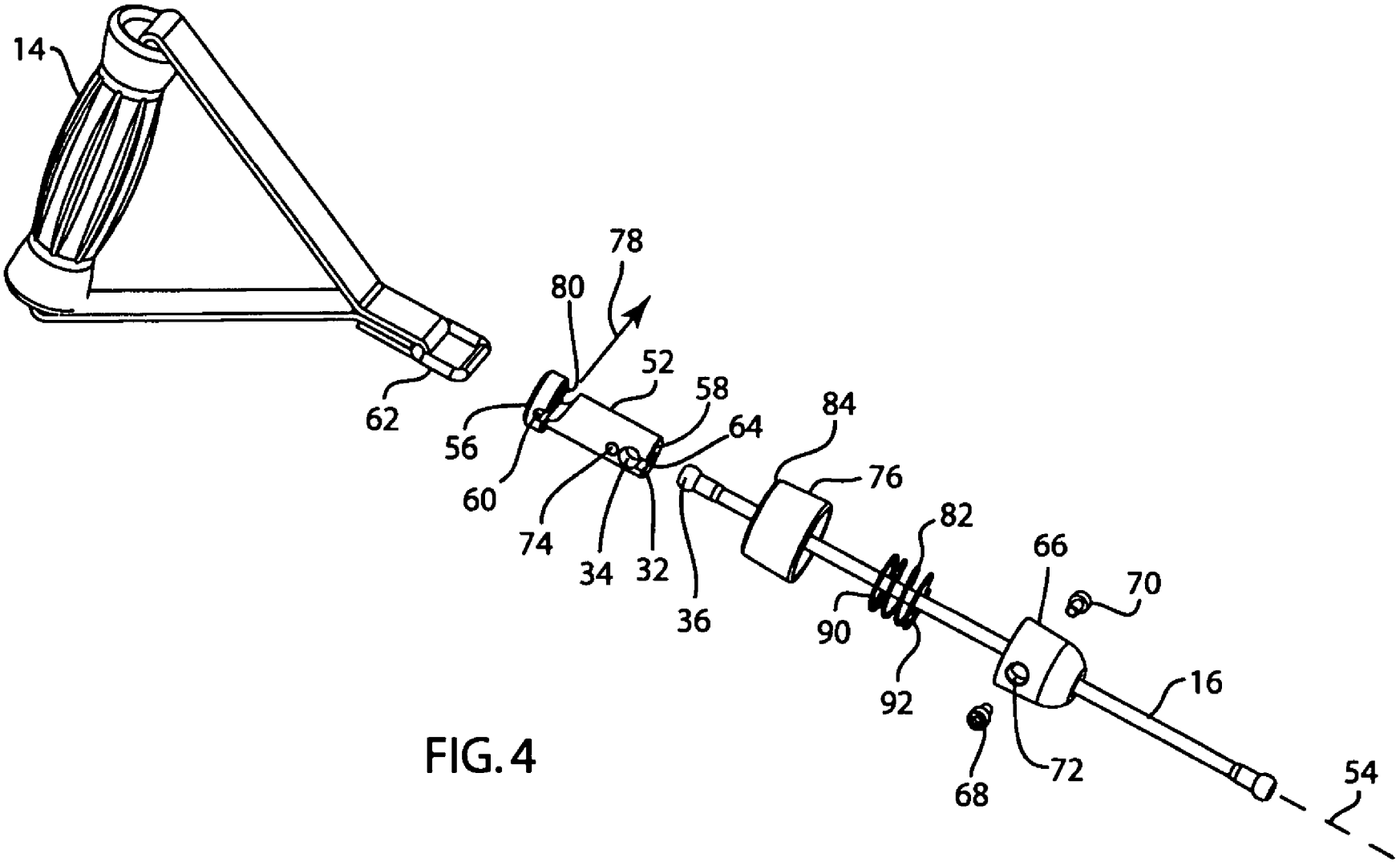
FIG. 4 is an exploded isometric view of the connection assembly of FIG. 3.
Figure 5:
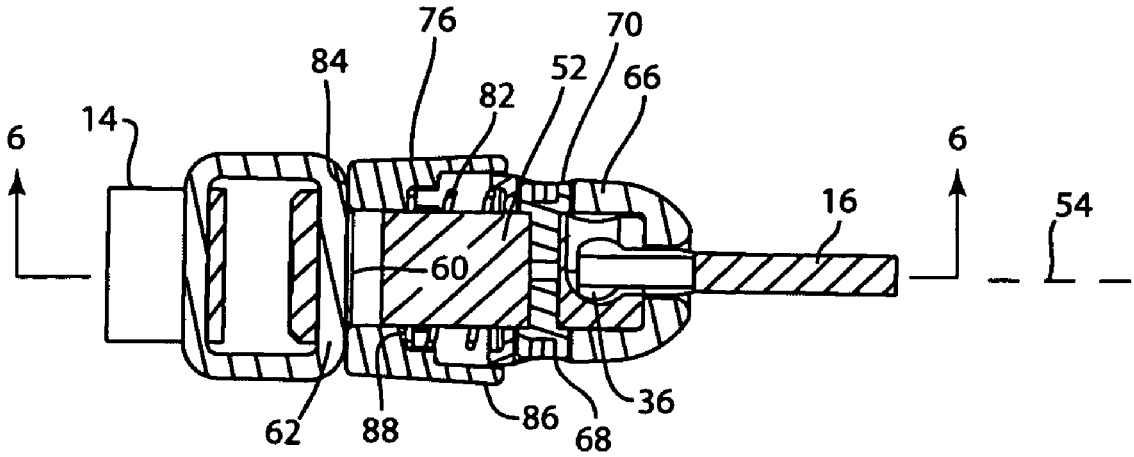
FIG. 5 is a sectional view of the connection assembly of FIG. 3.
Figure 6:
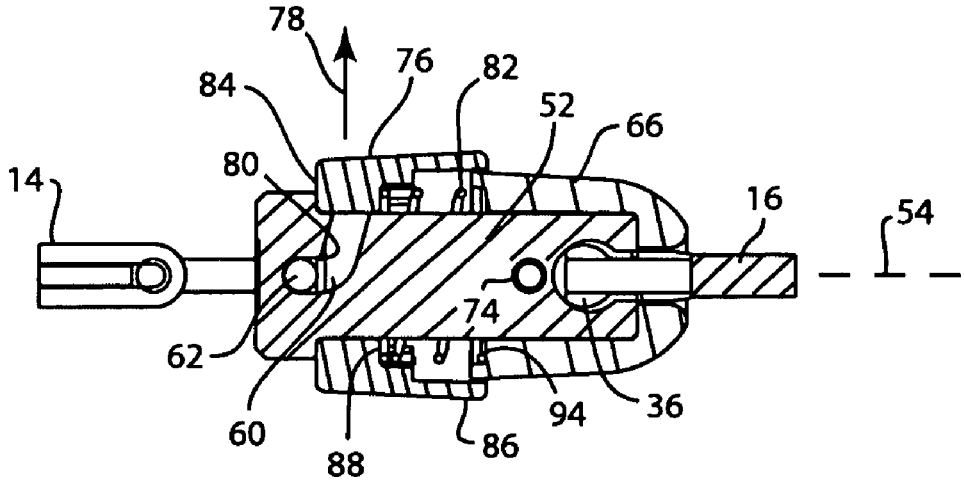
FIG. 6 is a sectional view taken along line 6-6 of FIG. 5.

A second collar 76 is provided around barrel 52 and is axially slidable along the barrel between a first axial position, FIGS. 3, 5, 6, retaining engagement of handle 14 and hook portion 60 of the barrel in hooked relation, and a second axial position releasing and enabling disengagement of handle 14 from hook portion 60 of barrel 52. Collar 76 slides axially leftwardly in FIGS. 3-6 toward handle 14 to the noted first axial position. Collar 76 slides axially rightwardly in FIGS. 3-6 away from handle 14 to the noted second axial position. Collar 76 provides a retainer moveable relative to barrel 52 between a leftward first locking position retaining engagement of handle 14 and axial end 56 of the barrel, and a rightward second release position releasing and enabling disengagement of handle 14 from axial end 56 of barrel 52. Retainer collar 76 is a user-grippable member moveable by the user between the noted first locking position and second release position without a tool.

Handle 14 at yoke 62 and hook portion 60 of barrel 52 disengage each other by radial movement as shown at arrow 78, FIG. 4, away from each other transverse to axis 54. Collar 76 in the noted first axial position blocks such radial movement of yoke 62 of handle 14 and hook portion 60 of barrel 52 away from each other. Yoke 62 of handle 14 and hook portion 60 of barrel 52 disengage each other by initial axial movement to clear hook lip 80, FIGS. 4, 6, e.g. rightward axial movement of yoke 62 in FIG. 6 past hook lip 80, followed by radial movement away from each other, e.g. radial outward movement of yoke 62 at arrow 78. Collar 76 in the noted first axial position, FIGS. 3, 5, 6, blocks the noted initial axial movement of yoke 62 of handle 14 as well as the noted radial separational movement.

A biasing member 82, FIG. 4, bears between the first and second collars 66 and 76, FIGS. 5, 6, and resiliently biases collar 76 to the noted first axial position, i.e. leftwardly in FIGS. 3-6. Collar 76 has a facing stop surface 84 providing the noted retaining engagement of yoke 62 of handle 14 and hook portion 60 of barrel 52 in the noted hooked relation in the noted first axial position of collar 76. Biasing member 82 is preferably a compression spring. Collar 76 has a skirt portion 86 extending axially rightwardly from stop surface 84 in an axial direction away from handle 14 and circumscribing and concentrically surrounding compression spring 82 in each of the noted first and second axial positions of collar 76, such that compression spring 82 is enclosed and covered by skirt portion 86 in each of the noted first and second axial positions of collar 76. Skirt portion 86 circumscribes and concentrically surrounds at least a portion of collar 66 in each of the noted first and second axial positions of collar 76 and axially slides therealong during movement of collar 76 between the noted first and second axial positions. Collar 76 has an axially facing surface 88, FIGS. 5, 6, facing axially away from handle 14. Compression spring 82 has a first axial end 90, FIG. 4, bearing against axially facing surface 88 of collar 76, and has a second distally opposite axial end 92 bearing against collar 66 at axially facing surface 94 thereof. Collar 76 has the noted axially facing surface 84 facing axially leftwardly toward and engaging yoke 62 of handle 14 in the noted first axial position of collar 76 to block the noted initial axial movement of yoke 62 of handle 14 relative to barrel 52, and enabling such axial movement of yoke 62 of handle 14 relative to barrel 52 upon compression of compression spring 82.

The present system provides a simple, effective and quick method for detaching and re-attaching a user-gripped handle 14 to a resistance-bearing cable 16 in a connection assembly 50 for exercise apparatus 10. The method involves axially sliding the noted second collar 76 from the noted first axial position to the noted second axial position to release and enable disengagement of yoke 62 of handle 14 from hook portion 60 of barrel 52, and axially sliding second collar 76 from the noted second axial position to the noted first axial position to retain engagement of yoke 62 of handle 14 and hook portion 60 of barrel 52 in the noted hooked relation.

It is recognized that various equivalents, alternatives and modifications are possible within the scope of the appended claims. For example, cable 16 may engage barrel 52 at end 58 in threaded relation, with or without collar 66, and may for example be retained or mounted by a jam nut or the like. If collar 66 is eliminated, the stop surface 94 for axial end 92 of compression spring 82 may be provided by a ledge, shoulder or the like on barrel 52. In another alternative, rather than axially sliding collar 76 along barrel 52, a retainer such as collar 76 or the like is rotated around barrel 52 between a locking position blocking removal of yoke 62 of handle 14, and a release position bringing a notch, opening or the like of the retainer into alignment with yoke 62 to enable removal of yoke 62 from the barrel. Other alternatives will be apparent to those of ordinary skill in the art.

What is claimed is:

1. Exercise apparatus comprising a user-gripped handle, a resistance-bearing cable, and a connection assembly for connecting said user-gripped handle to said resistance-bearing cable, comprising a barrel extending axially along an axis and having first and second distally opposite axial ends, said first axial end engaging said handle, said second axial end engaging said cable, a retainer moveable relative to said barrel between a first locking position retaining engagement of said handle and said first axial end of said barrel, and a second release position releasing and enabling disengagement of said handle from said first axial end of said barrel, wherein said first axial end of said barrel has a hook portion engaging said handle in hooked relation, and said second axial end of said barrel has a trap portion engaging said cable in trapped relation, and comprising a first collar around said barrel at said second axial end and attached to said barrel to retain said cable in trapped relation engaging said barrel, and wherein said retainer comprises a second collar around said barrel and axially slidable along said barrel between a first axial position retaining engagement of said handle and said hook portion of said barrel in said hooked relation, and a second axial position releasing and enabling disengagement of said handle from said hook portion of said barrel.

2. The exercise apparatus according to claim 1 wherein:

said second collar slides axially toward said handle to said first axial position;

said second collar slides axially away from said handle to said second axial position.

3. The exercise apparatus according to claim 1 wherein:

said handle and said hook portion of said barrel disengage each other by radial movement away from each other transverse to said axis;

said second collar in said first axial position blocks said radial movement of said handle and said hook portion of said barrel away from each other.

4. The exercise apparatus according to claim 3 wherein:

said handle and said hook portion of said barrel disengage each other by initial axial movement relative to each other, followed by said radial movement away from each other;

said second collar in said first axial position blocks said initial axial movement of said handle and said hook portion of said barrel relative to each other.

5. The exercise apparatus according to claim 1 comprising a biasing member bearing between said first and second collars and resiliently biasing said second collar to said first axial position.

6. The exercise apparatus according to claim 5 wherein:

said second collar has a stop surface providing said retaining engagement of said handle and said hook portion of said barrel in said hooked relation in said first axial position of said second collar;

said biasing member comprises a compression spring;

said second collar has a skirt portion extending axially in an axial direction away from said handle and circumscribing and concentrically surrounding said compression spring in each of said first and second axial positions of said second collar, such that said compression spring is enclosed and covered by said skirt portion in each of said first and second axial positions of said second collar.

7. The exercise apparatus according to claim 6 wherein said skirt portion of said second collar circumscribes and concentrically surrounds at least a portion of said first collar in each of said first and second axial positions of said second collar and axially slides therealong during movement of said second collar between said first and second axial positions.

8. The exercise apparatus according to claim 7 wherein:

said second collar has an axially facing surface facing axially away from said handle;

said compression spring has a first axial end bearing against said axially facing surface of said second collar, and has a second distally opposite axial end bearing against said first collar.

9. The exercise apparatus according to claim 8 wherein said second collar has a second axially facing surface facing axially toward and engaging said handle in said first axial position of said second collar to block axial movement of said handle relative to said barrel, and enabling axial movement of said handle relative to said barrel upon compression of said compression spring, said second axially facing surface providing said stop surface.

10. Exercise apparatus comprising a user-gripped handle, a resistance-bearing cable, and a connection assembly for connecting said user-gripped handle to said resistance-bearing cable, said handle having a yoke, said cable having an enlarged ball end, comprising a barrel extending axially along an axis and having first and second distally opposite axial ends, said first axial end having a hook portion engaging said handle at said yoke in hooked relation, said second axial end having a trap portion engaging said cable at said enlarged ball end in trapped relation, a first collar around said barrel at said second axial end and attached to said barrel to retain said cable in said trapped relation engaging said barrel, a second collar around said barrel and axially slidable along said barrel between a first axial position retaining engagement of said yoke of said handle and said hook portion of said barrel in said hooked relation, and a second axial position releasing and enabling disengagement of said yoke of said handle from said hook portion of said barrel, wherein said second collar slides axially toward said yoke of said handle to said first axial position, said second collar slides axially away from said yoke of said handle to said second axial position, said yoke of said handle and said hook portion of said barrel disengage each other by radial movement away from each other transverse to said axis, said second collar in said first axial position blocks said radial movement of said yoke of said handle and said hook portion of said barrel away from each other, and comprising a biasing member bearing between said first and second collars and resiliently biasing said second collar to said first axial position, wherein said second collar has a stop surface providing said retaining engagement of said yoke of said handle and said hook portion of said barrel in said hooked relation in said first axial position of said second collar, said biasing member comprises a compression spring, said second collar has a skirt portion extending axially in an axial direction away from said yoke of said handle and circumscribing and concentrically surrounding said compression spring in each of said first and second axial positions of said second collar, such that said compression spring is enclosed and covered by said skirt portion in each of said first and second axial positions of said second collar, wherein said skirt portion of said second collar circumscribes and concentrically surrounds at least a portion of said first collar in each of said first and second axial positions of said second collar and axially slides therealong during movement of said second collar between said first and second axial positions.

11. A method for detaching and re-attaching a user-gripped handle to a resistance-bearing cable in a connection assembly for exercise apparatus, comprising providing a user-gripped handle, providing a resistance-bearing cable, providing a barrel extending axially along an axis and having first and second distally opposite axial ends, providing said first axial end with a hook portion engaging said handle in hooked relation, providing said second axial end with a trap portion engaging said cable in trapped relation, providing a first collar around said barrel at said second axial end and attached to said barrel to retain said cable in said trapped relation engaging said barrel, providing a second collar around said barrel and axially slidable along said barrel between a first axial position retaining engagement of said handle and said hook portion of said barrel in said hooked relation, and a second axial position releasing and enabling disengagement of said handle from said hook portion of said barrel, and comprising axially sliding said second collar from said first axial position to said second axial position to release and enable disengagement of said handle from said hook portion of said barrel, and axially sliding said second collar from said second axial position to said first axial position to retain engagement of said handle and said hook portion of said barrel in said hooked relation.

12. The method according to claim 11 comprising:

axially sliding said second collar toward said handle to said first axial position;

axially sliding said second collar away from said handle to said second axial position.

13. The method according to claim 11 comprising:

axially sliding said second collar to said second axial position and disengaging said handle and said hook portion of said barrel by radially moving said handle and said hook portion of said barrel away from each other transverse to said axis;

re-engaging said handle and said hook portion of said barrel by radially moving said handle and said hook portion of said barrel towards each other transverse to said axis;

axially sliding said second collar to said first axial position to block radial movement of said handle and said hook portion of said barrel away from each other.

14. The method according to claim 13 comprising disengaging said handle and said hook portion of said barrel by initially axially moving said handle and said hook portion of said barrel axially relative to each other, followed by said radial movement away from each other, and re-engaging said handle and said hook portion of said barrel by initially radially moving said handle and said hook portion of said barrel towards each other, followed by axial movement relative to each other, followed by axially sliding said second collar to said first axial position to block said initial axial movement of said handle and said hook portion of said barrel relative to each other and said radial movement away from each other.

15. The method according to claim 11 comprising resiliently biasing said second collar to said first axial position by providing a biasing member bearing between said first and second collars.

16. The method according to claim 15 comprising:

providing said second collar with a stop surface providing said retaining engagement of said handle and said hook portion of said barrel in said hooked relation in said first axial position of said second collar;

providing said biasing member as a compression spring;

providing said second collar with a skirt portion extending axially in an axial direction away from said handle and circumscribing and concentrically surrounding said compression spring in each of said first and second axial positions of said second collar;

enclosing and covering said compression spring with said skirt portion in each of said first and second axial positions of said second collar.

17. The method according to claim 16 comprising circumscribing and concentrically surrounding at least a portion of said first collar with said skirt portion of said second collar in each of said first and second axial positions of said second collar, and axially sliding said skirt portion of said second collar along said first collar while axially moving said second collar between said first and second axial positions.

* * * * *